US007793531B2

(12) United States Patent
Baker

(10) Patent No.: US 7,793,531 B2
(45) Date of Patent: Sep. 14, 2010

(54) ADJUSTABLE CORRUGATING DIE SETS AND METHOD OF FORMING CORRUGATIONS OF VARYING CONFIGURATIONS

(76) Inventor: Gordon Baker, 4724 Surrey Way, Evansville, IL (US) 47725

( * ) Notice: Subject to any disclaimer, the term of this patent is extended or adjusted under 35 U.S.C. 154(b) by 321 days.

(21) Appl. No.: 11/985,570

(22) Filed: Nov. 15, 2007

(65) Prior Publication Data

US 2008/0127706 A1 Jun. 5, 2008

Related U.S. Application Data

(60) Provisional application No. 60/866,107, filed on Nov. 16, 2006.

(51) Int. Cl.
*B21D 13/00* (2006.01)

(52) U.S. Cl. ..... 72/379.6; 72/385; 72/473; 72/481.3

(58) Field of Classification Search ..... 72/379.6, 72/383, 385, 414, 473, 474, 475, 478, 481.1, 72/481.3, 481.8; 493/459, 463, 464; 264/286; 425/336, 396

See application file for complete search history.

(56) References Cited

U.S. PATENT DOCUMENTS

| | | | | |
|---|---|---|---|---|
| 1,941,078 | A | 12/1933 | Eriksson | |
| 2,369,486 | A * | 2/1945 | Nivison | 72/385 |
| 2,440,809 | A | 5/1948 | Olney | |
| 2,481,049 | A | 9/1949 | Stamm et al. | |
| 3,307,387 | A * | 3/1967 | Lacey, Jr. et al. | 72/324 |
| 3,340,719 | A | 9/1967 | Kandle et al. | |
| 4,250,728 | A * | 2/1981 | King | 72/177 |
| 4,347,726 | A * | 9/1982 | Naslund | 72/385 |
| 4,434,637 | A * | 3/1984 | Bailey | 72/18.5 |
| 4,635,462 | A | 1/1987 | Bald | |
| 5,694,803 | A * | 12/1997 | Ervin et al. | 72/385 |
| 6,502,447 | B2 * | 1/2003 | Adams et al. | 72/326 |
| 6,834,525 | B2 | 12/2004 | Leon et al. | |

* cited by examiner

*Primary Examiner*—Edward Tolan
(74) *Attorney, Agent, or Firm*—John R. Benefiel

(57) ABSTRACT

An adjustable die set and method for forming corrugations in a sheet in which pairs of elongated forming bars are detachably mounted parallel to each other in respective holders driven by upper and lower press members. One pair is more closely spaced than the other and moves between the forming bars of the other pair to form a corrugation. The spacing and depth of the bar is varied to produce corresponding varying configurations of the corrugations.

14 Claims, 4 Drawing Sheets

ADJUSTABLE CORRUGATING DIE SETS AND METHOD OF FORMING CORRUGATIONS OF VARYING CONFIGURATIONS

CROSS REFERENCE TO RELATED APPLICATION

This application claims the benefit of U.S. provisional application Ser. No. 60/866,107 filed on Nov. 16, 2006.

BACKGROUND OF THE INVENTION

This invention relates to tooling and methods for forming corrugations into sheet metal.

Corrugations are formed into metal sheets in order to strengthen the same against bending loads for such uses as floor panels subjected to heavy loads.

The use of conventional die sets can be used where the production volume of a given corrugated panel is sufficient to justify the cost of the die set which is typically quite high.

Another method is to form a series of bends in the sheet using standard forming tools, but this is very time consuming as four separate bending operations are required for each corrugation and this process also requires turning over the sheet or plate for each bend.

While adjustable tooling for forming parts has been proposed in the past, such as shown in U.S. Pat. Nos. 2,440,809 and 6,834,525, these have not been suitable for forming heavy duty corrugated sheet for such applications as panels used for the bottom of cargo barges, trucks, and the like.

It is the object of the present invention to provide an adjustable die set and method for forming corrugations in relatively thick sheet metal with a single press operation to enable a number of varying corrugation configurations to be formed with a single low cost die set.

SUMMARY OF THE INVENTION

The above recited object and other objects which will be understood upon a reading of the following specification and claims are achieved by a die set including an upper and lower die each constructed of individual components which can be assembled in different ways or with components of different dimensions to create different corrugation configurations in a forming press.

The individual components themselves can be made at low cost and of varied dimensions to enable formation of a great number of corrugation configurations by assembling the components in alternative ways.

The individual die components each comprise a pair of die forming bars having a radiused or rounded shoulder on one or more corners. The die forming bars are mounted assembled on edge to a holder with one or more interposed spacers to be spaced apart and parallel to each other with the rounded shoulders located opposite each other in one die but away from each other in another die, both pairs of forming bars spaced a part a distance corresponding to a given corrugation dimension desired. The two pairs of die bars are spaced apart at different distances to create a clearance allowing one pair of forming bars to move between the other forming bar pair, and thus produces inclined corrugation sidewalls extending between the rounded corners of a forming bar in one pair to the rounded corner on the other adjacent forming bar of the other pair without any contact with the inclined corrugation sides.

In the upper die, a block may comprise a spacer while in the lower die a U-shaped holder may be used allowing the upper die set forming bar pair to enter a space between the lower die set forming bar pair.

This arrangement allows a great number of corrugation configurations to be formed in a single press cycle, with the relative width of the upper die pair set and lower die forming bar pair producing a given inclination of the formed corrugation side walls, as the relative width of the flattened bottom varies with the relative spacings of the sets of upper and lower die forming bar pairs.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
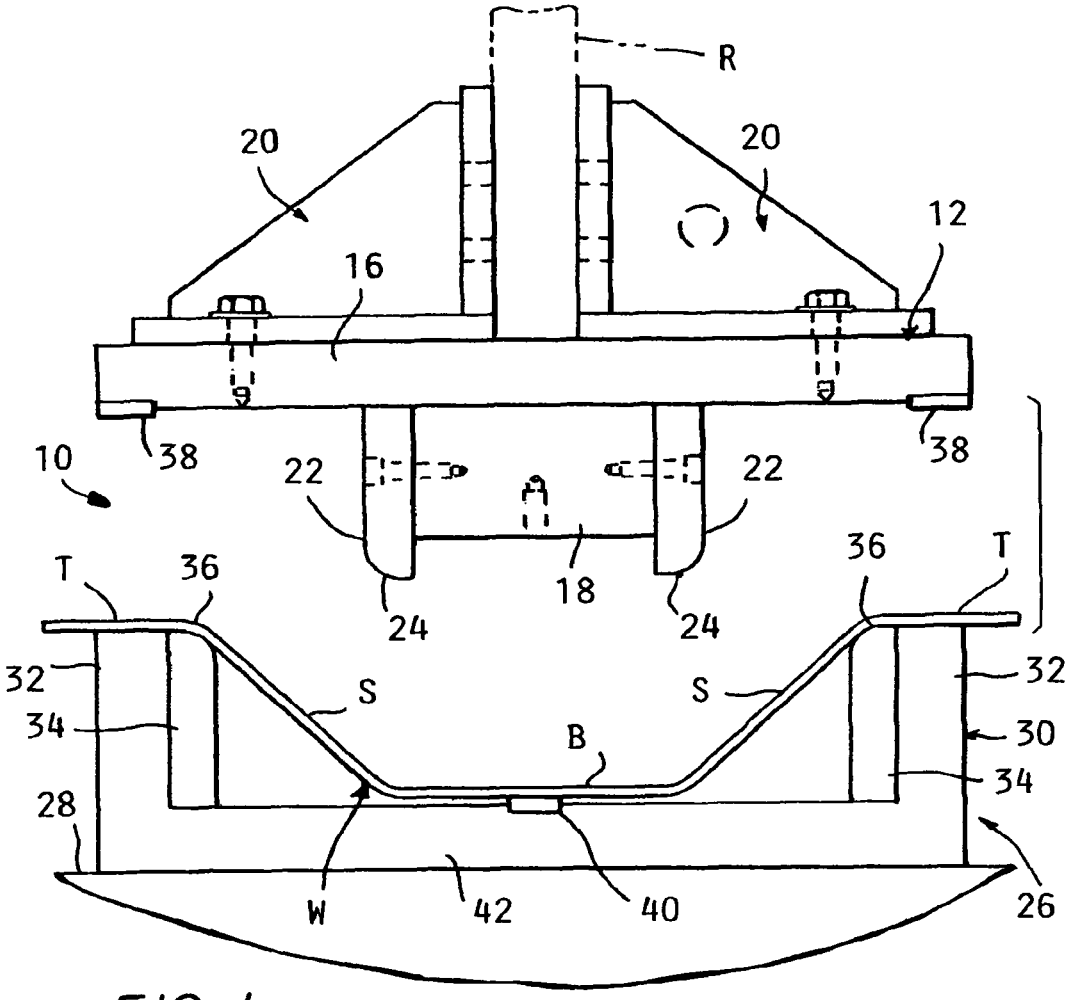
FIG. 1 is an end view of an adjustable die set according to the present invention installed on press upper and lower ram members with a section of sheet material disposed the die set and having a corrugation formed therein by operation of the press.
Figure 2:
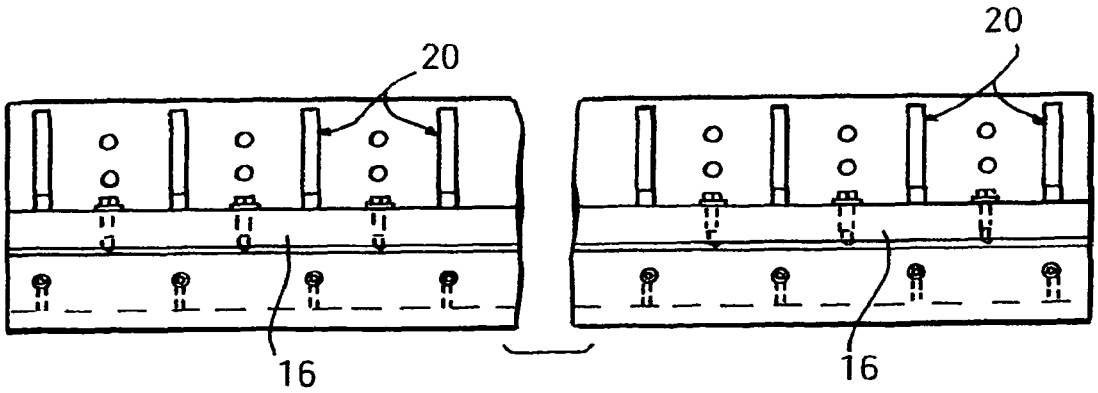
FIG. 2 is a side view of the upper die shown in FIG. 1.
Figure 1A:
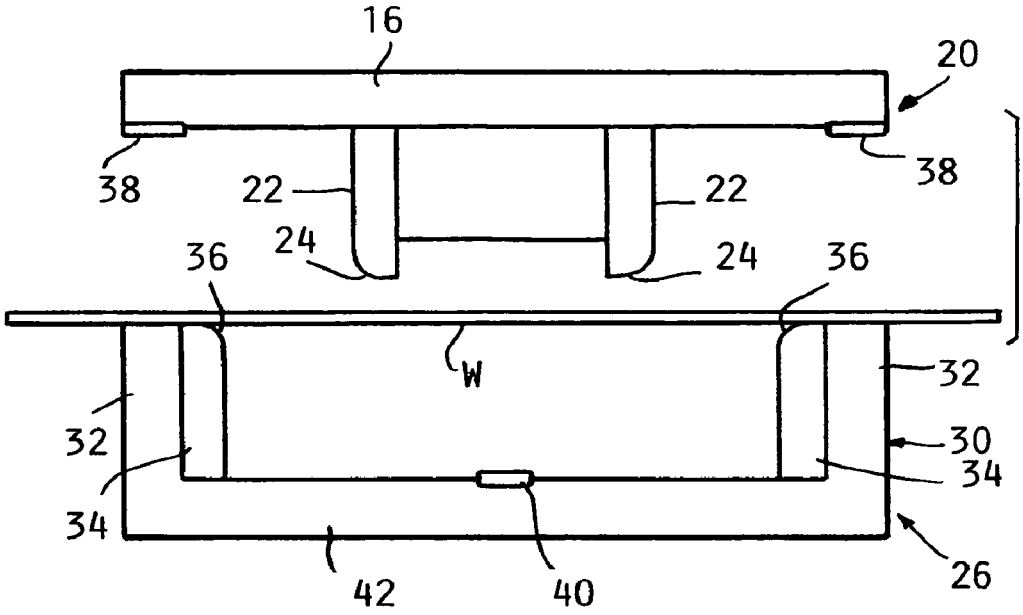
FIG. 1A is an end view of the die set shown in FIG. 1 with an unformed sheet section disposed therein prior to a forming operation of the press.

Referring to the drawings, FIG. 1 shows a corrugation forming die set 10 according to the present invention.

The upper die 12 includes a die holder member comprised of a flat plate 16 having a mounting spacer block 18 welded or otherwise affixed to the underside thereof. A series of angle brackets 20 are bolted to the upper side of the holder plate 16.

The angle brackets 20 are spaced apart to receive the press ram R to which they may be bolted as indicated. This distributes the load imposed on the plate 16 during forming operations.

Disposed beneath the underside of the plate 16 and attached to opposite sides of the mounting spacer block 18 as by screws are a pair of on edge elongated forming bars 22 parallel to each other and projecting downwardly from the underside of the holder plate 16.

Figure 9:
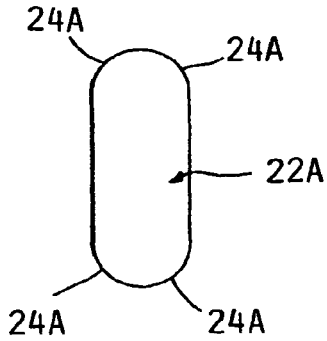
FIG. 9 is an end view of an alternative shape of a die bar.

The forming bars 22 are radiused at 24 on at least their lower corners facing away from each other. This radius approximately corresponds to the radius desired to be formed at the intersection of the corrugation sides S and bottom B of the sheet metal workpiece W. The forming bars 22A may also be rounded at 24A as seen in FIG. 9 to be reversible.

A lower die 26 is adapted to be secured on the press bed 28 and includes a U-shaped base 30 having a pair of spaced apart upright parallel legs 32, each having attached one of a pair of spaced apart parallel forming bar 34 affixed on edge to the inside of a respective leg 32 projecting upwardly.

Each of the lower die forming bars 34 have a radiused corner 35 facing towards each other approximately corresponding to the desired radius between the intersecting corrugation sides S and tops T.

The forming bars 22 of the upper die 12 are more closely spaced than the forming bars 34 of the lower die 26 to be able to move between the forming bars 34 during forming of a corrugation in a sheet metal workpiece P.

The clearance space between the two sets of forming bars 22, 34 and the depth of the forming bars determines the inclination of the sidewalls S of the corrugation in the sheet P as indicated.

The corrugation sides S may be formed with a greater or lesser inclination depending on the location and dimensions of the die components. The inclination is typically of interest to a designer as the less inclination of the sides the stronger the corrugated panels are, but more material is required as the sides S become steeper. Thus, this inclination can be set to a designer's requirements by varying the relative widths A, B between the forming bars 22, 34.

The depth of the corrugations is another parameter which can be controlled by varying the heights of the pairs of forming bars 22, 34.

Hardened wear strips 38 can be installed on the under surface of the die holder plate 16 along each side which can also act as thin spacers for slightly adjusting the depth that the forming bars 22 reach into the lower die 26.

Figure 1B:
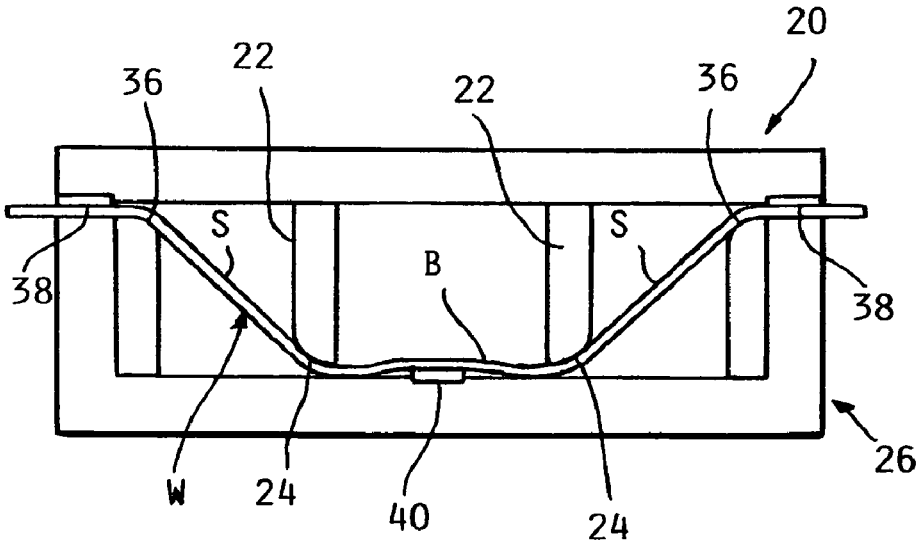
FIG. 1B is an end view of the die set shown in FIG. 1 with the upper and lower dies advanced together by the press operation to form a corrugation in a sheet disposed in the die set.

A resilient strip 40 (polyurethane, 90 durometer) may be partially recessed into the bottom 42 of U-shaped base 30 to "overbend" the bottom B and make the same flatter by compensating for spring back (see FIG. 1B).

Figure 3:
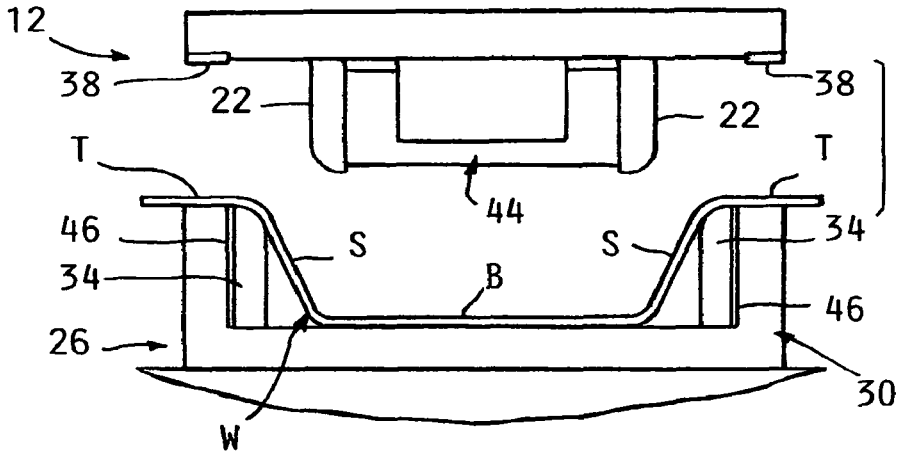
FIG. 3 is an end view of a second arrangement of individual components of the upper and lower dies and a section of sheet material disposed therein and having a different corrugation configuration formed therein.

FIG. 3 shows a change in the location of the components and thus the corrugation configuration by increasing the spacing width of the upper die pair of forming bars 22 by adding a U-shaped spacer 44 and narrowing slightly the width of the spacing of the lower die forming bars 34 by adding a thin spacer sheet 46.

The sides S of the corrugation will thereby be formed at a steeper angle.

Figure 4:
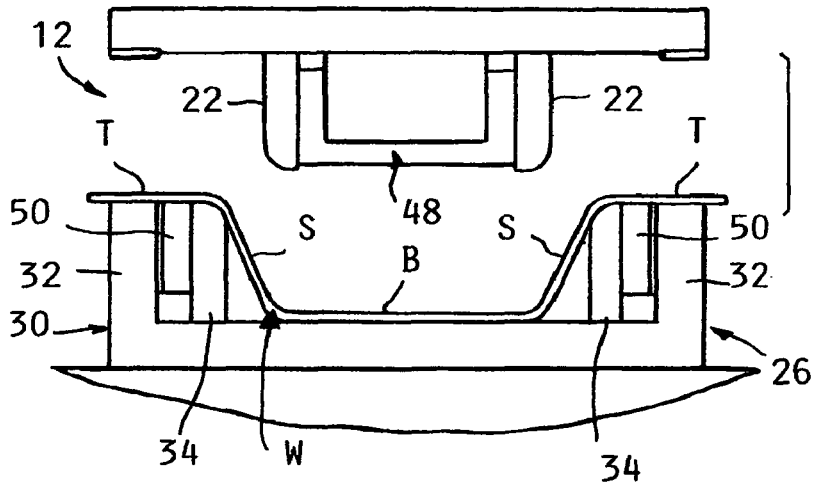
FIG. 4 is an end view of a third arrangement of individual components of the upper and lower dies and a sheet section disposed therein having another corrugation configuration formed therein.

In FIG. 4, a narrower U-shaped spacer 48 is used with the upper die pair of forming bars 22 and thicker spacers 50 are assembled between the legs 32 and the forming bars 34 to create slightly steeper corrugation sides S.

Figure 5:
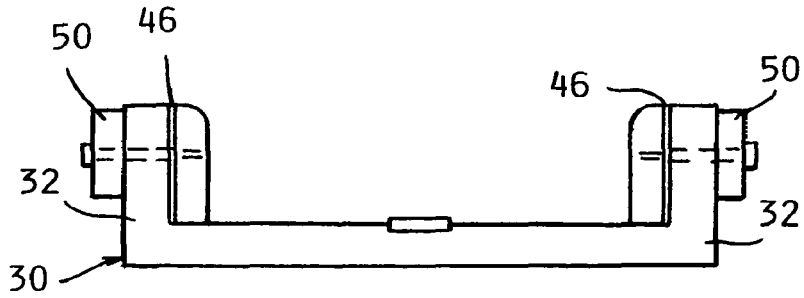
FIG. 5 is an end view of a lower die showing an assembly of spacers thereon.
Figure 6:
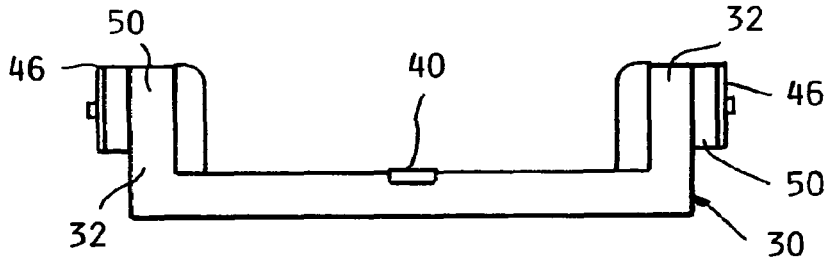
FIG. 6 is an end view of a lower die with a variation of the assembly of spacers thereon.
Figure 7:
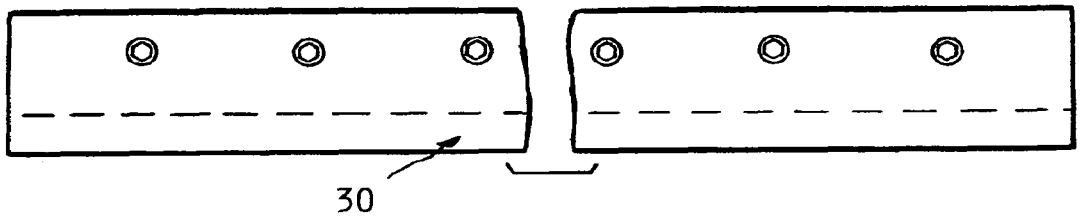
FIG. 7 is a side view of the lower die shown in FIGS. 5 and 6.

FIGS. 5 and 6 show how the thin sheet spacers 48 and thick spacers 50 can be switched and/or both stowed on the sides of the legs 32.

Figure 8:
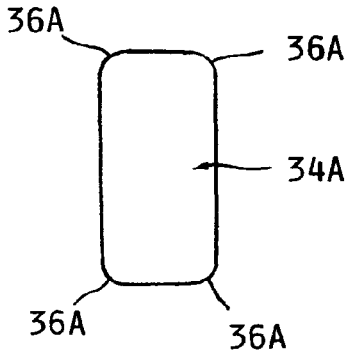
FIG. 8 is an end view of an alternative shape of a die bar.

FIG. 8 shows an alternative shape of the forming bars 34A in which all four corners 36A are radiused. This allows switching of the exposed corners to the engaging position to extend the life of the bar 34A.

FIG. 9 shows another alternative shape of the forming bars 22A in which both ends may be rounded to in effect provide four larger radius corners 24A.

In use, the upper and lower dies are of a length to form a corrugation the full length of the sheet W. After each corrugation is formed, the sheet W is then shifted between the dies to bring the next unformed section into position in readiness for forming the next corrugation, and so on until the sheet W is formed with the number of corrugations required.

The forming bars and spacers are configured as necessary to form the desired corrugation. The individual components are simple and able to be made cheaply to allow almost any desired corrugation geometry to be formed and eliminates the necessity of having many conventional dies or of using the very slow process of forming the corrugations by successive bending operations while allowing a great number of corrugation configurations to be made.

The invention claimed is:

1. A method of press forming corrugations of a selected width into a sheet comprising:

detachably mounting a first pair of separate spaced apart parallel elongated forming bars on edge to a die holder mounted on a press ram member, spacing apart said first pair of forming bars at a distance corresponding to the spacing of a first set of corrugation bends;

detachably mounting a second pair of separate spaced apart parallel elongated forming bars on edge to a base member mounted on another press ram member, said second pair of forming bars positioned in alignment with said first pair of forming bars, spacing apart said second pair of forming bars a distance corresponding to the spacing of a second set of corrugation bends, said first and second pairs of forming bars spaced apart a different distance so that said forming bars in said first pair of forming bars is more narrowly spaced apart and fits within the space between said forming bars in said second pair of more widely spaced forming bars with a clearance therebetween;

placing said sheet between said first and said second pair of forming bars and advancing said first pair of forming bars into the space between said second pair of forming bars by press operation to engage with said sheet and thereby form a corrugation therein as said first pair of forming bars moves between said other pair of forming bars moves between said second pair of forming bars; and repeating said operation on successive sections of said sheet to corrugate the same.

2. The method according to claim 1 further including forming a corrugation of any selected depth by mounting forming bars of a selected height in said press corresponding to said selected corrugation depth.

3. The method according to claim 1 further including forming inclined sides on said corrugations of selected angle of inclination by spacing one of said pairs of forming bars apart a distance less than a spacing of the other pair of forming bars a distance corresponding to said selected angle of inclination of said formed corrugation sides.

4. The method according to claim 1 further including spacing said pairs of forming bars a predetermined selected apart distance by interposing one or more spacer pieces of a selected thickness between said forming bars to produce a desired corrugation shape.

5. The method according to claim 4 wherein said forming bars are detachably mounted to said interposed one or more spacer pieces.

6. The method according to claim 1 wherein the more narrowly spaced pair of said forming bars are each formed with a radiused corners located away from each other and the more widely spaced pair of forming bars are each formed with a radiused corner adjacent each other to form corresponding radiused corners in said corrugation sides, bottom and top respectively.

7. The method according to claim 6 wherein all four corners of said forming bars are radiused to enable reversible mounting to achieve longer wear.

8. A corrugation forming die set comprising:

a die holder plate adapted to be affixed to one press actuator member;

a pair of separate spaced apart elongated forming bars individually detachably mounted on edge and parallel to each other to said die holder plate so as to project downwardly therefrom; and a base adapted to be attached to another press actuator member and having a another pair of separate spaced apart elongated forming bars individually detachably mounted on edge and parallel to each other to said base projecting therefrom, said pairs of forming bars spaced apart different distances such that one pair of forming bars is more closely spaced apart than the other pair of forming bars and is received within the space between the more widely spaced apart pair of forming bars upon advancement therebetween by operation of said press.

9. The die set according to claim 8 wherein said one of said pair of forming bars which are more narrowly spaced apart have radiused corners located away from each other and the more widely spaced apart pair of forming bars have radiused corners adjacent each other.

10. The die set according to claim 9 wherein all four corners of each forming bar are radiused to enable reverse mounting of said forming bars to achieve longer wear life thereof.

11. The die set according to claim 8 further including one or more detachable spacer pieces associated with each pair of forming bars to space the same apart at a selected distance corresponding to the width of said spacer pieces.

12. The die set according to claim 8 wherein said base member is U-shaped having a pair of upwardly projecting legs with each forming bars in said more widely spaced apart pair of forming bar being detachably attached to a respective leg.

13. The die set according to claim 8 wherein each forming bar in said more closed spaced apart pair of forming bars are detachably affixed to a respective side of a spacer block fixed to said holder plate.

14. The die set according to claim 13 wherein a spacer element is interposed between each side of said block and a respective forming bar.

* * * * *

UNITED STATES PATENT AND TRADEMARK OFFICE

CERTIFICATE OF CORRECTION

PATENT NO. : 7,793,531 B2
APPLICATION NO. : 11/985570
DATED : September 14, 2010
INVENTOR(S) : Baker It is certified that error appears in the above-identified patent and that said Letters Patent is hereby corrected as shown below:

Col. 4, line 51, before "selected" insert -- a --.

Signed and Sealed this
Twenty-first Day of June, 2011

David J. Kappos

David J. Kappos
*Director of the United States Patent and Trademark Office*